US007681263B1

(12) United States Patent
Hawkins

(10) Patent No.: US 7,681,263 B1
(45) Date of Patent: Mar. 23, 2010

(54) MODULAR PILLOW SYSTEMS

(76) Inventor: Tanya L. Hawkins, 252 Shearwater Isle, Foster City, CA (US) 94404

( * ) Notice: Subject to any disclaimer, the term of this patent is extended or adjusted under 35 U.S.C. 154(b) by 0 days.

(21) Appl. No.: 12/328,342

(22) Filed: Dec. 4, 2008

(51) Int. Cl.
*A47G 9/10* (2006.01)

(52) U.S. Cl. ..... 5/640; 5/645; 5/490

(58) Field of Classification Search ..... 5/636, 5/639, 640, 645, 490, 491
See application file for complete search history.

(56) References Cited

U.S. PATENT DOCUMENTS

| | | | | |
|---|---|---|---|---|
| 1,020,444 | A * | 3/1912 | Platt | 5/645 |
| 4,754,513 | A * | 7/1988 | Rinz | 5/490 |
| 5,020,174 | A * | 6/1991 | Sarkozi | 5/640 |
| 5,940,913 | A | 8/1999 | Horowitz | |
| 6,151,733 | A * | 11/2000 | Takashima | 5/636 |
| 6,182,312 | B1 | 2/2001 | Walpin | |
| 6,317,908 | B1 | 11/2001 | Walpin | |
| 6,408,467 | B2 | 6/2002 | Walpin | |
| 6,490,743 | B1 * | 12/2002 | Adat et al. | 5/645 |
| 6,641,220 | B2 * | 11/2003 | Clegg | 297/397 |
| 6,978,502 | B2 * | 12/2005 | Calagui | 5/640 |
| 6,993,800 | B2 | 2/2006 | Greenawalt et al. | |
| 2005/0262637 | A1 * | 12/2005 | Funatogawa | 5/636 |
| 2005/0278852 | A1 | 12/2005 | Wahrmund et al. | |
| 2007/0245493 | A1 | 10/2007 | Leifermann et al. | |
| 2008/0086819 | A1 | 4/2008 | Valero Pavia | |

* cited by examiner

*Primary Examiner*—Michael Trettel
(74) *Attorney, Agent, or Firm*—Renner, Otto, Boisselle & Sklar, LLP

(57) ABSTRACT

Modular pillow systems include one or two individual bolster component(s) and a traditional pillow component. When two bolster components are employed, the traditional pillow component is positioned between the two bolster components, and when one bolster component is employed, the traditional pillow component is positioned to one side of the bolster component. The density and diameter and/or size of the individual modular components may be selected based on the anatomical characteristics and/or comfort and support characteristics of the user. The bolster component(s) and the traditional pillow component may be contained in a shell or cover or conventional pillowcase sized and dimensioned to snugly fit around the bolster component(s) and traditional pillow component and hold the components together.

16 Claims, 2 Drawing Sheets

MODULAR PILLOW SYSTEMS

FIELD OF THE INVENTION

This invention relates to modular pillow systems that provide for customized comfortable support for a user's head and neck covering a wide range of users' anatomical characteristics and/or comfort preferences.

BACKGROUND OF THE INVENTION

There are a wide variety of pillows currently on the market. Most traditional pillows are made of fabric and are filled with materials such as feathers, down and polyester fiber. Traditional pillows generally take on an elliptical shape, but more recently, pillow manufacturers have begun offering traditional pillows with gusseted sides to add loft to the pillows in an effort to add support. However, due to both the shape and fill in such pillows, they are less than ideal in providing proper support to a user's head, neck and shoulder(s) during sleep. This can make for an uncomfortable night's sleep and may lead to physical problems such as neck and back pain, shoulder pain, headaches and general stiffness and tension in the neck and upper back areas. Over time, this may lead to more serious chronic and/or permanent conditions of the neck, spine or back. Traditional pillows are not designed to offer varying support in different areas.

In an effort to solve some of these problems, different types of support pillows have entered the market. The most common of these are contoured pillows made of a foam material, such as polyurethane foam, also known as memory or support foam. One of the disadvantages of these pillows is that while they may offer sufficient support for the neck and shoulders, they tend to be too firm in the area where the user's head rests and are therefore uncomfortable while sleeping for any length of time. Another disadvantage is that because these pillows are generally flat on the bottom and the contours are of different size, they cannot be flipped over or rotated and still maintain their intended purpose. Most of these pillows tend to be smaller than traditional pillows and therefore the user has a smaller surface on which to rest the user's head while sleeping. These pillows are not customizable and do not account for variations in the anatomical characteristics or comfort preference of different users.

SUMMARY OF THE INVENTION

The present invention relates to modular pillow systems that address the above-mentioned deficiencies with existing pillows. The pillow systems of the present invention are comprised of multiple components of different composition and densities which may be selected by the user to support the user's particular anatomy and satisfy the user's comfort preference, and when combined, provide the desired support for the neck and shoulder areas while offering users comfortable head support.

In accordance with one aspect of the invention, the pillow systems of the present invention are comprised of one or two individual bolster component(s) and a traditional pillow component. The support bolster component(s) provide the neck support, while the traditional pillow component provides the comfort of a standardized traditional pillow. Given the design, the pillow systems can be flipped over, and when two bolsters are employed, can also be rotated 180° like a standardized traditional pillow and still perform its intended function.

In accordance with another aspect of the invention, when two bolster components are employed, the traditional pillow component is positioned between the two bolster components. When one bolster component is employed the traditional pillow component is positioned to one side of the bolster component.

In accordance with another aspect of the invention, the bolster component(s) and the traditional pillow component may be contained within a shell or cover.

In accordance with another aspect of the invention, the shell or cover may be sized and dimensioned to snugly fit around the bolster component(s) and traditional pillow component and may hold the components together. Alternatively, the components may be fastened together and then placed in the shell or cover.

In accordance with another aspect of the invention, the shell or cover may be compartmentalized internally to hold the components together.

In accordance with another aspect of the invention, the shell or cover may have a suitable fastener device for ease of inserting and/or removing any or all of the pillow system components as needed.

These and other advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

The present invention may be more readily understood by reference to the following drawings in which.

DETAILED DESCRIPTION OF THE INVENTION

As used herein, the term "traditional pillow" refers to the outer shape of a traditional pillow comprised of one or more pieces of ticking sewn together along their edges (with or without gussets) and filled with a suitable pillow filling such as down, feathers, cellulose padding, polyester fiber, and so on.

Figure 1:
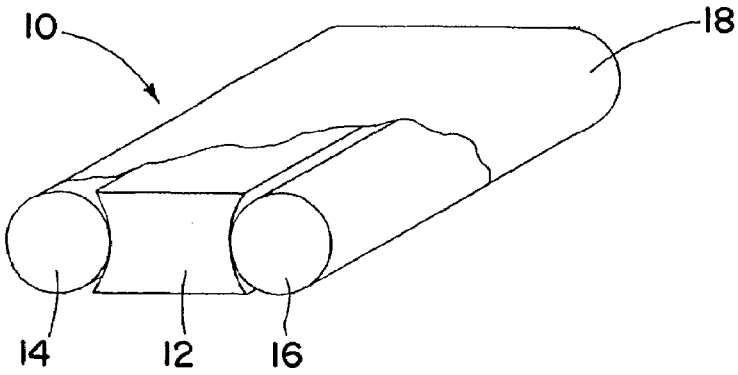
FIGS. 1 and 2 are schematic perspective views of two different forms of pillow systems of the present invention as seen from one end, with portions of the shell or cover broken away. The pillow system shown in FIG. 1 includes two bolster components and a traditional pillow component disposed therebetween within the shell or cover, whereas the pillow system shown in FIG. 2 includes only one bolster component and the traditional pillow component positioned to one side of the bolster component.
Figure 2:
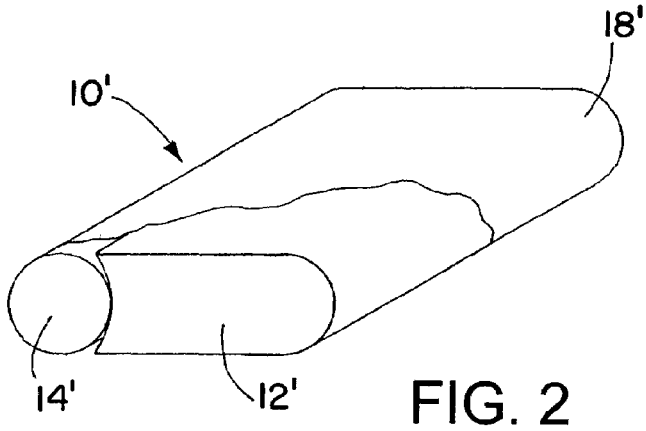
Figure 5:
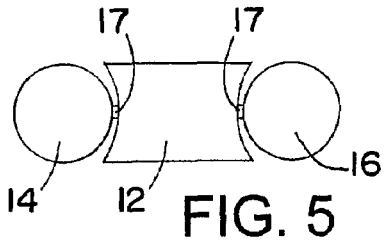
FIGS. 5 and 6 are end views respectively showing two and one individual bolster component(s) fastened to both and one side(s) of a traditional pillow component.

Referring now more particularly to the drawings, wherein the same reference numbers followed by a prime symbol (') are used to designate like parts, and initially to FIGS. 1 and 2, there are shown two forms of pillow systems 10 and 10' according to the present invention. In FIG. 1, pillow system 10 is formed by combining three individual components 12, 14 and 16 and placing the components within a shell or cover 18, which may be a standardized pillowcase or a specially designed and sized shell or cover as described hereafter. One of the components 12 has a traditional pillow shape, but generally may be smaller in width than a conventional traditional pillow. Component 12 is a center component which is disposed between the other two components 14 and 16, which are bolster components that may be formed of a suitable resilient material such as foam. All three components 12, 14 and 16 may be fitted or fastened together using a suitable fastening device 17 such as a zipper, snap fasteners, or loop and hook fasteners as shown in FIG. 5 and placed inside the shell or cover 18 to form the unitary pillow system 10 of the present invention.

Figure 6:
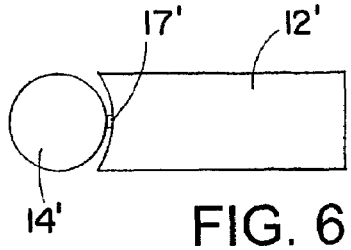

In FIG. 2, pillow system 10' is formed by combining two individual components 12' and 14' and fitting or fastening the two components together using a suitable fastening device 17' as shown in FIG. 6 and placing the components within a shell or cover 18'. Shell or cover 18 or 18' may be a standardized pillowcase or a specially designed and sized shell or cover as described hereafter. Component 12' has a traditional pillow shape, but generally may be smaller in width than a conventional traditional pillow, and is positioned to one side of the other component 14', which is a bolster component that may be crafted of a suitable resilient material such as foam.

Figure 3:
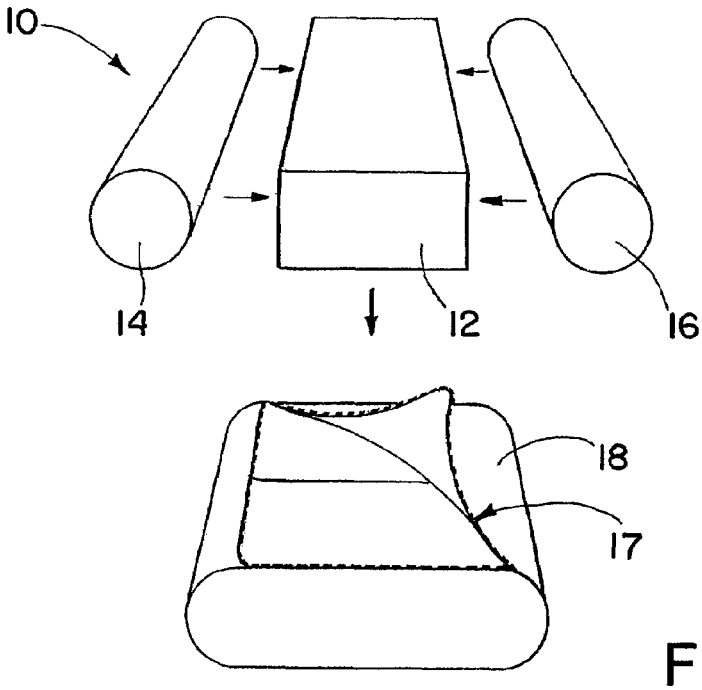
FIGS. 3 and 4 are schematic exploded perspective views of the pillow systems of FIGS. 1 and 2, respectively.
Figure 4:
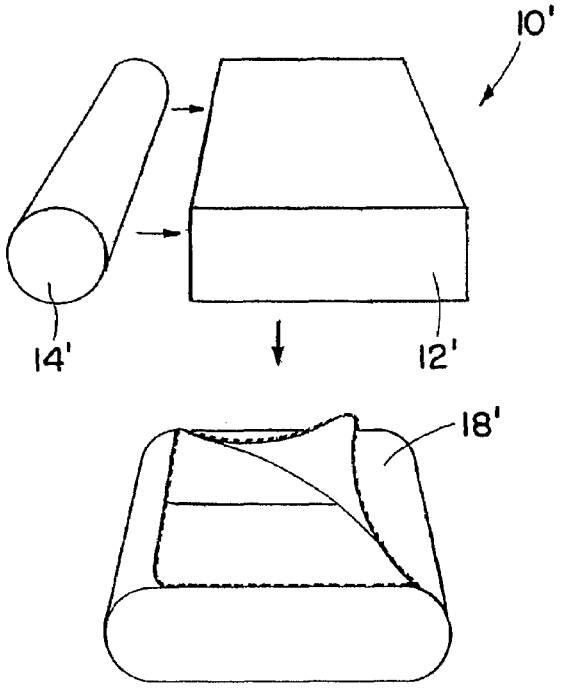

FIGS. 2 and 3 are schematic exploded perspective views of the pillow systems 10 and 10' of FIGS. 1 and 2, from which it can be seen that the bolster component(s) 14, 14' (and 16 if employed) are column shaped neck bolster(s) and are of substantially the same size, shape and length along their longitudinal axes, thus allowing them to be interchanged when assembling the pillow system when two bolsters are employed. Also the neck bolster(s) are shown as being cylindrical in cross section. However, it will be appreciated that the neck bolster(s) may also be of other cross-sectional shapes, including but not limited to oval or square if desired, and still provide the desired support. These neck bolster(s) may be formed of a resilient material, such as viscoelastic polyurethane foam more commonly known as memory foam, or crafted of any other suitable material that provides the desired support and comfort to the user. The center component 12, 12' is a small version of a conventional traditional pillow, with or without gussets, it may have a width less than the width of a conventional traditional pillow to take into account the width of the neck bolsters. The density of the center component 12, 12' is generally based on the desired comfort and support of the user.

The pillow systems 10, 10' of the present invention may be made in various sizes and adjusted to user preference. For example, the diameter/thickness and width of the neck bolsters 14, 14' (and 16 if employed) may be determined based on a user's anatomical characteristics and comfort and support preference. Therefore, both the width and thickness of the traditional pillow component 12, 12' may change based on the dimensions of the neck bolster(s) 14, 14' (and 16) so that when assembled, the components may fit into a standardized pillowcase, or a customized case of various sizes. Also because the pillow systems are of a modular structure as shown in the various drawing figures, they provide for ease of multiple price pillow systems, that is, pillow systems that have the same modular components but with different prices based on the users' selected combination of size, density and/or materials to be used for each of the selected components 12, 12', 14, 14' (and 16).

Figure 7:
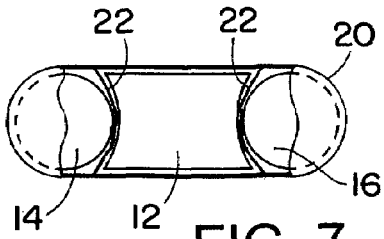
FIGS. 7 and 8 are end views respectively of other pillow systems of the present invention with end portions of the shell or cover broken away to show separate internal compartments inside the shell or cover in which the traditional pillow component and two and one bolster component(s) are received.
Figure 8:
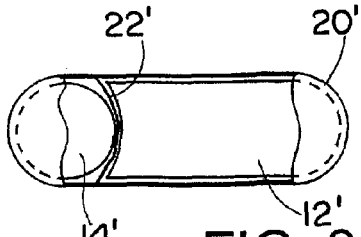

If the shell or cover 18, 18' is a specially designed and sized shell or cover, it is desirably constructed of a soft, stretchy textile such as cotton terrycloth/polyester blend, and is sized such that the selected components 12, 12', 14, 14' (and 16 if employed) will fit snugly within the shell or cover and may provide a way to hold the individual components together. Alternatively, the components 12, 12' and 14, 14' (and 16 if employed) may be fastened together using suitable fasteners 17, 17' as schematically shown in FIGS. 5 and 6 and then placed in the shell or cover. However, the shell or cover 20, 20' may also be compartmentalized internally for each component as by providing internal baffles or partitions 22, 22' inside the shell or cover as shown in FIGS. 7 and 8 and therefore provide another way in which to hold the components together.

Figure 9:
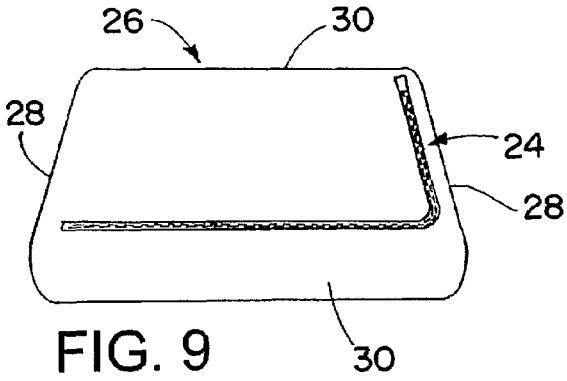
FIG. 9 is a schematic perspective view of a pillow system as seen from one side and illustrates one variation of a fastening device that allows for easy insertion and/or removal of any or all of the components into or from the shell or cover.
Figure 10:
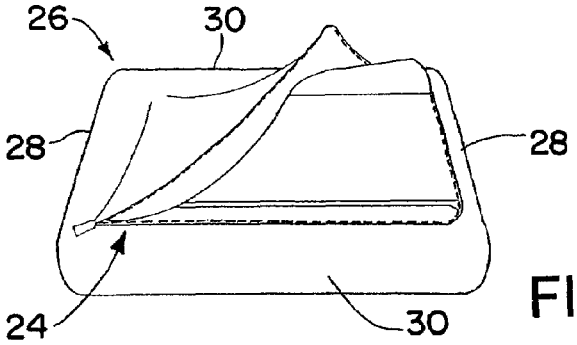
FIG. 10 is a schematic perspective view of the pillow system of FIG. 9 showing the cover fastening device completely open for ease of inserting and/or removing any or all of the pillow system components as needed.

A suitable fastening device 24 may be applied to the shell or cover 26 such as a zipper, buttons, snap fasteners, or loop and hook fastener tapes. FIGS. 9 and 10 illustrate one variation of how the fastening device 24 may be implemented by having it extend along substantially the entire length and width of one or both sides 28 and one or both ends 30 of the shell or cover for ease of inserting and/or removing any or all of the pillow components 12, 12', 14, 14' and/or 16 as needed.

Once the pillow systems are assembled with either the traditional pillow component 12, 12' disposed between the two bolster components 14 and 16 (or on one side when using only one bolster 14'), the pillow systems can be flipped over or rotated 180° when two bolsters are employed, and still perform its intended function.

From the foregoing, it can be seen that the adaptability and modular characteristics of the pillow systems of the present invention provide customized comfortable support for the head and neck of different users covering a wide range of body types and individual comfort preferences by permitting bolster components having different densities and/or sizes to be selected to satisfy different users' anatomical characteristics and/or comfort and support preferences. Similarly, different traditional pillow components having different widths and thicknesses and/or fill material may be selected based on user preferences and the size and/or density of the ballast components. Likewise, the size of the shell or cover may be determined by the selected density and/or size of the bolster components and traditional pillow component.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to described such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to a particular embodiment, such feature may be combined with one or more other features as may be desired and advantageous for any given or particular application.

What is claimed is:

1. A pillow system comprising at least one individual bolster component and a separate traditional pillow component of substantially the same length, the bolster component having one side in substantial alignment with one side of the traditional pillow component and an opposite side spaced longitudinally outwardly from the one side of the traditional pillow component to provide support for a user's neck by the bolster component independently of the support provided by the traditional pillow component for the user's head, and a shell or cover containing the bolster component and the traditional pillow component, wherein the shell or cover is sized and dimensioned to snugly fit around the bolster component and the traditional pillow component, with the bolster component and the traditional pillow component in side by side relation to one another for supporting the user's neck by the bolster component and supporting the user's head by the pillow component.

2. The pillow system of claim 1 wherein the shell or cover has an opening extending substantially the full length of one or both sides and/or one or both ends of the shell or cover for ease of inserting and/or removing one or more of the components from the shell or cover, and fastening means for selectively closing the full length of the opening, the components being insertable and removable from the shell or cover through the opening when not closed by the fastening means.

3. The pillow system of claim 2 wherein the fastening means is any one of a zipper, buttons, snap fasteners, and hook and loop fastening devices running the length of the opening.

4. The pillow system of claim 1 wherein the shell or cover has separate longitudinally spaced internal compartments in which the individual components are received with the one side of the bolster component adjacent the one side of the traditional pillow component and the opposite side of the bolster component spaced longitudinally outwardly from the one side of the traditional pillow component.

5. The pillow system of claim 1 wherein the individual components are held together by means of a fastening device between the one side of the traditional pillow component and the one side of the individual bolster component.

6. The pillow system of claim 1 wherein the density and diameter and/or size of the bolster component is based on anatomical characteristics and/or comfort and support preferences for supporting the user's neck.

7. The pillow system of claim 6 wherein the width and thickness of the traditional pillow component is based on the diameter and/or size of the bolster component and/or comfort and support preferences for supporting the user's head.

8. The pillow system of claim 7 wherein the size of the shell or cover is based on the diameter and/or size of the bolster component and width and thickness of the traditional pillow component.

9. The pillow system of claim 1 wherein the bolster component is selected from a group of modular bolster components of different densities and diameters and/or sizes based on anatomical characteristics and/or comfort and support preferences for supporting the user's neck.

10. The pillow system of claim 9 wherein the traditional pillow component is selected from a group of modular traditional pillow components having different widths and thicknesses and fill materials based on the density and diameter and/or size of the selected bolster component and/or comfort and support preferences for supporting the user's head.

11. The pillow system of claim 10 wherein the shell or cover is selected from a group of shells or covers of different sizes based on the diameter and/or size of the selected bolster component and width and thickness of the selected traditional pillow component.

12. The pillow system of claim 1 wherein an internal baffle or partition extends between opposite ends of the shell or cover intermediate opposite sides of the shell or cover to provide two separate longitudinally spaced internal compartments inside the shell or cover in which the respective bolster component and traditional pillow component are received.

13. The pillow system of claim 1 wherein there are two individual bolster components of substantially the same size and length, and the traditional pillow component is positioned between the two bolster components with one side of the bolster components in substantial alignment with respective sides of the traditional pillow component and opposite sides of the bolster components spaced longitudinally outwardly from the respective sides of the traditional pillow component, whereby the pillow system can be flipped over or rotated 180° and still perform its intended function.

14. The pillow system of claim 13 wherein the individual components are held together by means of separate fastening devices between opposite sides of the traditional pillow component and the one side of the respective individual bolster components.

15. The pillow system of claim 13 wherein the shell or cover has separate longitudinally spaced internal compartments in which the individual components are received with the one side of the bolster components aligned with respective sides of the traditional pillow component and opposite sides of the bolster components spaced longitudinally outwardly from the respective sides of the traditional pillow component.

16. The pillow system of claim 13 wherein two longitudinally spaced internal baffles or partitions extend between opposite ends of the shell or cover intermediate opposite sides of the shell or cover to provide two separate longitudinally spaced internal side compartments in which the two individual bolster components are received and an intermediate internal compartment between the two longitudinally spaced internal side compartments in which the traditional pillow component is received.

* * * * *